US011214083B2

(12) United States Patent
Astorgano-Ballesteros et al.

(10) Patent No.: US 11,214,083 B2
(45) Date of Patent: Jan. 4, 2022

(54) STEPPER MOTOR-BASED PRINT ADJUSTMENTS

(71) Applicant: HEWLETT-PACKARD DEVELOPMENT COMPANY, L.P., Spring, TX (US)

(72) Inventors: Angel Astorgano-Ballesteros, Vancouver, WA (US); Ranjit Bhaskar, Vancouver, WA (US); Praveen Boppana, Vancouver, WA (US); Stuart Douglas Spencer, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 113 days.

(21) Appl. No.: 16/661,028

(22) Filed: Oct. 23, 2019

(65) Prior Publication Data

US 2021/0122178 A1 Apr. 29, 2021

(51) Int. Cl.

| | |
|---|---|
| ***B41J 13/00*** | (2006.01) |
| ***B41J 11/00*** | (2006.01) |
| ***B41J 29/393*** | (2006.01) |
| ***B41J 25/308*** | (2006.01) |
| ***B41J 29/38*** | (2006.01) |

(52) U.S. Cl.

CPC ..... *B41J 13/0018* (2013.01); *B41J 11/0095* (2013.01); *B41J 25/3088* (2013.01); *B41J 29/38* (2013.01); *B41J 29/393* (2013.01)

(58) Field of Classification Search

CPC .... B41J 13/0018; B41J 11/0095; B41J 29/38; B41J 29/393; B41J 25/3088; B41J 2/325

See application file for complete search history.

(56) References Cited

U.S. PATENT DOCUMENTS

| | | | | |
|---|---|---|---|---|
| 7,400,430 | B2 | 7/2008 | Czyszczewski et al. | |
| 8,451,518 | B2 | 5/2013 | Calamita | |
| 2004/0047659 | A1 | 3/2004 | Harada et al. | |
| 2008/0024851 | A1 | 1/2008 | Sakaue et al. | |
| 2011/0025743 | A1 | 2/2011 | Mizes | |
| 2013/0044151 | A1* | 2/2013 | Masuda | B41J 13/0009 347/16 |
| 2015/0242731 | A1 | 8/2015 | Iwama et al. | |
| 2016/0114593 | A1* | 4/2016 | Ume | B41J 2/36 347/211 |

* cited by examiner

*Primary Examiner* — Henok D Legesse

(74) *Attorney, Agent, or Firm* — Fabian VanCott

(57) ABSTRACT

In one example in accordance with the present disclosure, a printing system is described. The printing system includes a media sensor to detect a presence of media at a particular point within the printing system. A stepper motor moves media through the printing system. A controller 1) monitors, for at least one pass of the media, a number of steps of the stepper motor to pass the media between the media sensor and a print position, 2) stores the number of steps of the stepper motor in a memory device, and 3) adjusts operation of subsequent passes of the media based on stored number of steps. A memory device of the printing system stores the number of steps of the stepper motor, for at least one pass of the media.

20 Claims, 12 Drawing Sheets

STEPPER MOTOR-BASED PRINT ADJUSTMENTS

BACKGROUND

Printing systems are used to deposit compounds, such as ink, on a substrate surface such as paper. One particular type of printing system, a dye sublimation printer uses heat to transfer dye onto materials such as plastic, card, paper, or fabric. Specifically, a dye on a ribbon passes over the media. Heaters in a printhead heat different portions of the dye to cause the dye to vaporize and transfer onto media under the dye ribbon.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
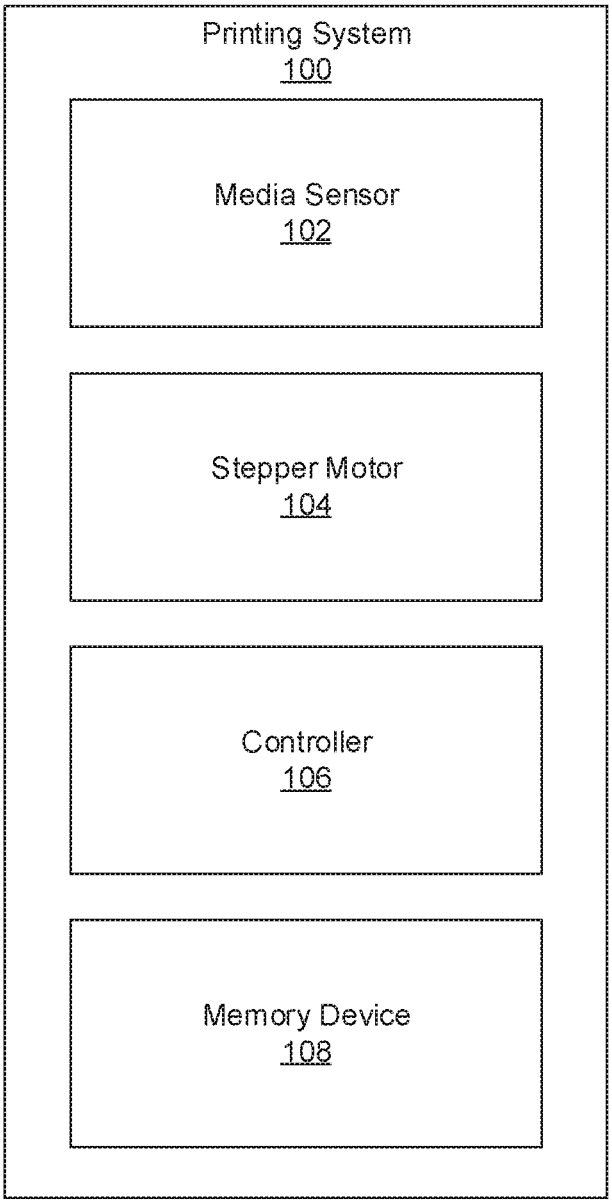
FIG. 1 is a block diagram of a printing system that makes stepper-based print adjustments, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Printing systems are used to deposit fluid, such as ink, on a substrate surface such as paper. There are many different types of printing systems, each that deposit fluid on a substrate surface in a different way. One particular type of a printing system is a dye sublimation printer which can deposit a dye onto a variety of surfaces including plastic, card, paper, or fabric. In dye sublimation printing, different cellophane "panels" of different color dye are arranged end-to-end along a polyester ribbon. The ribbon and the media pass underneath a thermal printhead. The thermal printhead includes a linear array of thermal elements that are individually controllable to heat to different temperatures. The heat causes the dye to sublimate and permeate into the structure of the media.

Accordingly, along a direction perpendicular to the media transport path, the pattern of activation of different thermal elements lays down the dye in a particular pattern. As the media moves, each thermal element may be selectively pulsed generating a variable temperature between the thermal elements to lay down a pattern in a direction parallel to media transport path. This process forms an image/text of the respective dye on the media as the ribbon is squeezed between the thermal printhead and the media. The media may be reversed and the process repeated for each color dye such that a full color image is sublimated onto the media.

As the dye permeates the media, rather than simply being deposited on a surface of the media, dye sublimation results in permanent printing that is less susceptible to fading, distortion, and/or cracking. Moreover, as the dye permeates the surface, there is a less conspicuous border for each pixel, thus making the resulting image higher resolution and more realistic.

While dye sublimation printing systems provide high quality prints, some adjustments to their operation may enhance the quality of the output. For example, as described above, the ribbon includes panels for different dye colors to be applied. In a specific example, a ribbon includes four panels. A first for yellow, a second for magenta, a third for cyan, and a fourth with a protective coating material. Therefore, each print job passes the media under the thermal printhead for each ribbon panel for a total of four passes.

A print job may exhibit artifacts resulting from misregistration where the relative location of each ribbon panel and the media changed between passes. That is, in between passes, when media is reversed to receive a new dye color, the starting point of printing the new dye color may not align with the starting point of a previous pass.

It is preferable that these start points are the same for each color pass so that no misregistration between colors is noticeable when observing the resulting output. Specifically, the passes should be identical in distance as well as the start and finish positions while both the media and ribbon are being pressed against the printhead so that, misregistration between colors on photo is not visible.

Accordingly, the present specification describes a system and method to address misregistration in printing systems such as dye sublimation printers. Specifically, a stepper motor may be used to advance the media. The stepper motor moves the media in discrete incremental "steps". According to the present disclosure, a number of steps taken by the stepper motor to move the media from two distinct points in the printing system are measured and stored. This number of steps represents the relative distance between a position where printing is started and a media sensor where the media may be reversed back through the printing system. This stored value can be used in subsequent passes to ensure that subsequent passes align with the first pass. How the number of steps are calculated and used for subsequent adjustment may take a variety of forms as will be describe in below figures.

Specifically, the present specification describes a printing system. The printing system includes a media sensor to detect a presence of media at a particular point within the printing system and a stepper motor to move the media through the printing system. The printing system also includes a controller. The controller monitors, for at least one pass of the media, a number of steps of the stepper motor to pass media between the media sensor and a print position. The controller stores the number of steps of the stepper motor in a memory device and adjusts operation of subsequent passes of the media based on stored number of steps.

The printing system also includes a memory device to store the number of steps of the stepper motor, for at least one pass of the media.

The present specification also describes a method. According to the method, a number of steps of a stepper motor to pass media between a media sensor and a print position is monitored for at least one pass of media through a printing region. Data associated with the number of steps of the stepper motor is stored in a memory device. A controller adjusts operation of subsequent passes of the media through the printing region based on stored data.

The present specification also describes a non-transitory machine-readable storage medium encoded with instructions. The instructions are executable by a processor. The instructions 1) monitor, for at least one pass of media through a printing region, a number of steps of a stepper motor to pass media between a media sensor and a print position; 2) store data associated with the number of steps of the stepper motor in memory; and 3) adjust operation of subsequent passes of the media through the printing region based on stored data such that a start point of printing is the same for each pass.

Such systems and methods 1) reduce the cost associated with the use of an open-loop media drive; 2) prevent misalignment of color registration in a printed output; and 3) result in a higher quality printed output.

As used in the present specification and in the appended claims, the term, "controller" refers to various hardware components, which includes a processor and memory. The processor includes the hardware architecture to retrieve executable code from the memory and execute the executable code. As specific examples, the controller as described herein may include computer-readable storage medium, computer-readable storage medium and a processor; an application-specific integrated circuit (ASIC); a semiconductor-based microprocessor, a central processing unit (CPU), and a field-programmable gate array (FPGA), and/or other hardware device.

The memory may include a computer-readable storage medium which computer-readable storage medium may contain, or store computer-usable program code for use by or in connection with an instruction execution system, apparatus, or device. The memory may take many types of memory including volatile and non-volatile memory. For example, the memory may include Random Access Memory (RAM), Read Only Memory (ROM), optical memory disks, and magnetic disks, among others. The executable code may, when executed by the respective component; cause the component to implement at least the functionality described herein.

Further, as used in the present specification and in the appended claims, the term "leading edge" refers to the edge of a sheet of media that first receives the dye compound and that first exits the printing system upon completion of the print job.

By comparison, as used in the present specification and in the appended claims; the term "trailing edge" refers to the edge of a sheet of media that last receives the dye compound and that last exits the printing system upon completion of the print job.

Further, as used in the present specification and in the appended claims, the term "print position" refers to the position where printing is initialized for media.

Turning now to the figures, FIG. 1 is a block diagram of a printing system (100) that makes stepper-based print adjustments, according to an example of the principles described herein. As described above, the printing system (100) may be a dye sublimation printer that sublimates dye on a ribbon to permeate an underlying media.

The printing system (100) may include a media sensor (102) that detects a presence of media at a particular point within the printing system (100). In some examples, the media be an individual sheet of media. When media is over the media sensor (102), the media sensor (102) may be "ON". By comparison, when no media is over the media sensor (102), it may be "OFF". The media sensor (102) may be coupled to the controller (106) which uses the output of the media sensor (102) to trigger operations of the printing system (100). Other operations may be triggered by the media sensor (102) as well. The media sensor (102) may take a variety of forms including an optical reader that visually perceives the presence of the media. In another example, the media sensor (102) may read registration marks formed on the substrate.

The media sensor (102) is used during media retrieval to 1) detect that media has been successfully retrieved from a media tray for printing and 2) to set the print position after retrieving the media. However, in the present specification, the media sensor (102) is additionally used to trigger stepper motor (104) step monitoring.

The printing system (100) also includes a stepper motor (104) that moves paper through the printing system (100). As described above, the stepper motor (104) may operate in distinct increments. For example, the stepper motor (104) may have discrete degrees of rotation. With each incremental step, the media is advanced a certain amount. Accordingly, as will be described below, these incremental steps can be used to calibrate the printing system (100) such that each pass, i.e., pertaining to different colors, starts at the same point relative to the media such that no misregistration occurs.

The stepper motor (104) may move the media through the printing system (100) in either direction. That is, as described above, media passes by a printing region multiple times, each pass pertaining to deposition of a different compound. Accordingly, during a pass, the stepper motor (104) may operate to move media in one direction, then after the pass the stepper motor (104) may operate to move the media in the opposite direction such that a subsequent pass may be executed.

The printing system (100) also includes a controller (106) to monitor, for at least one pass of media, a number of steps of the stepper motor (104) to pass media between the media sensor (102) and a print position. The controller (106) stores the number of steps monitored in a memory device (108) and adjusts the operation of subsequent passes of the media based on the stored number of steps.

The monitoring and adjusting may take a variety of forms. In one scenario, the controller (106) monitors, for each of multiple passes, the number of steps to pass media from the print position to the media sensor (102) and similarly stores, for each of multiple passes, the number of steps to pass media from the print position to the media sensor (102). Examples of these particular methods are provided below in connection with FIGS. 4A, 4B, and 5.

In another scenario, the controller (106) monitors, for just a first pass, the number of steps of the stepper motor (104) to pass media from the media sensor (102) to the print position and similarly stores, for just a first pass, the number of steps of the stepper motor (104) to pass media from the media sensor (102) to the print position. An example of this method is provided below in connection with FIG. 6.

In other words, in some examples, stepper motor (104) steps are calculated for each pass and in others, just for a single pass. Similarly, in some examples, stepper motor (104) steps are calculated moving along a media path, i.e., from the print position to the media sensor (102), and in other examples, steps are calculated moving media against the media path, i.e., from the media sensor (102) to the print position. In either case, the determined number of steps may be used to adjust subsequent passes so that with each pass, a particular location on the media, i.e., a registration point, aligns properly with each dye panel so that no misregistration occurs.

Figure 4A:
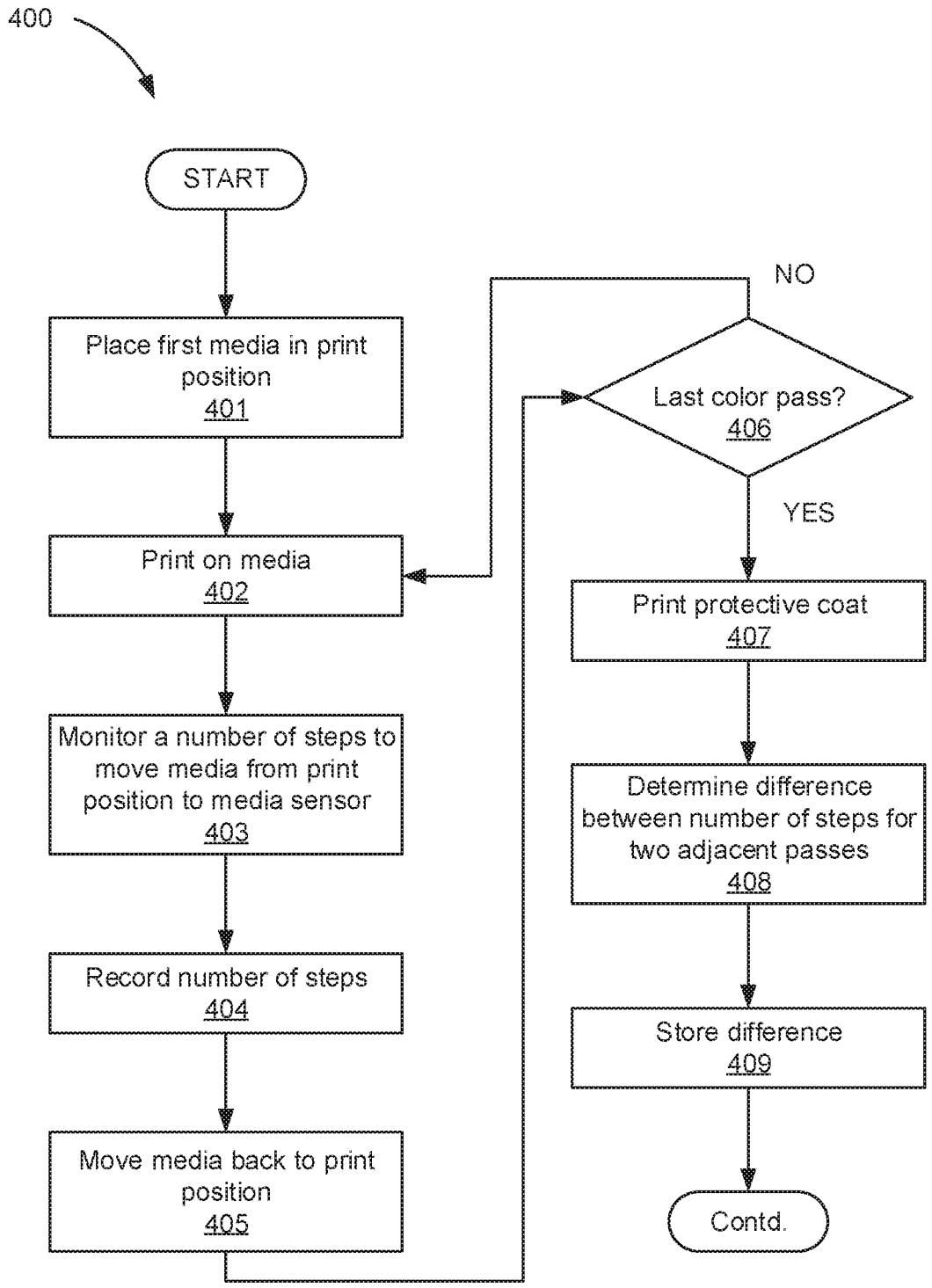
FIGS. 4A and 4B are flow charts of a method for stepper motor-based print adjustments, according to another example of the principles described herein.
Figure 4B:
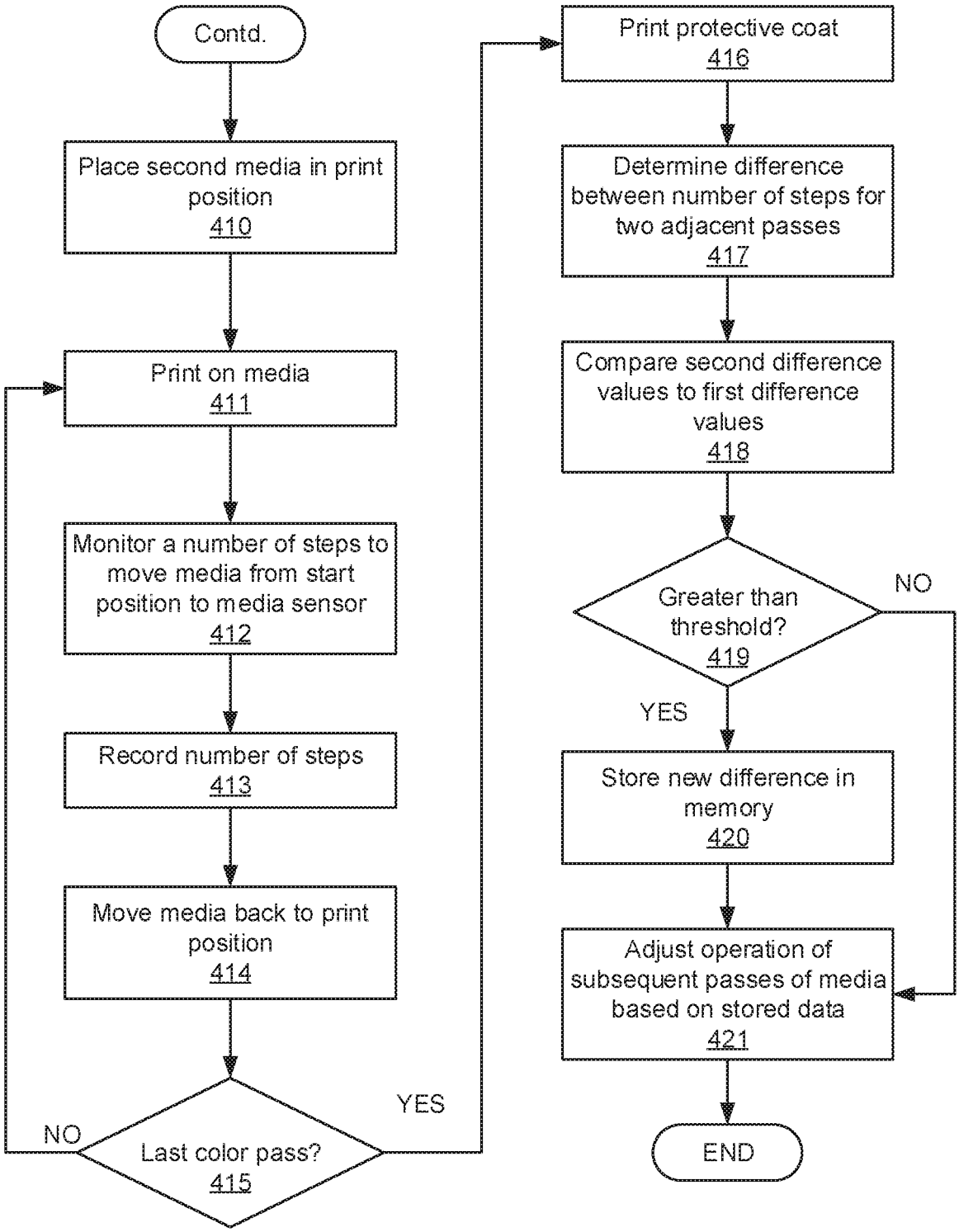

In some examples, the controller (106) monitors and stores the number of steps during a calibration period. That is, before a job is printed, calibration may be done to determine any adjustments to be made to the operation of the printing system (100) during job printing. FIGS. 4A and 4B depict specific examples of calibration-based printing adjustments.

Figure 5:
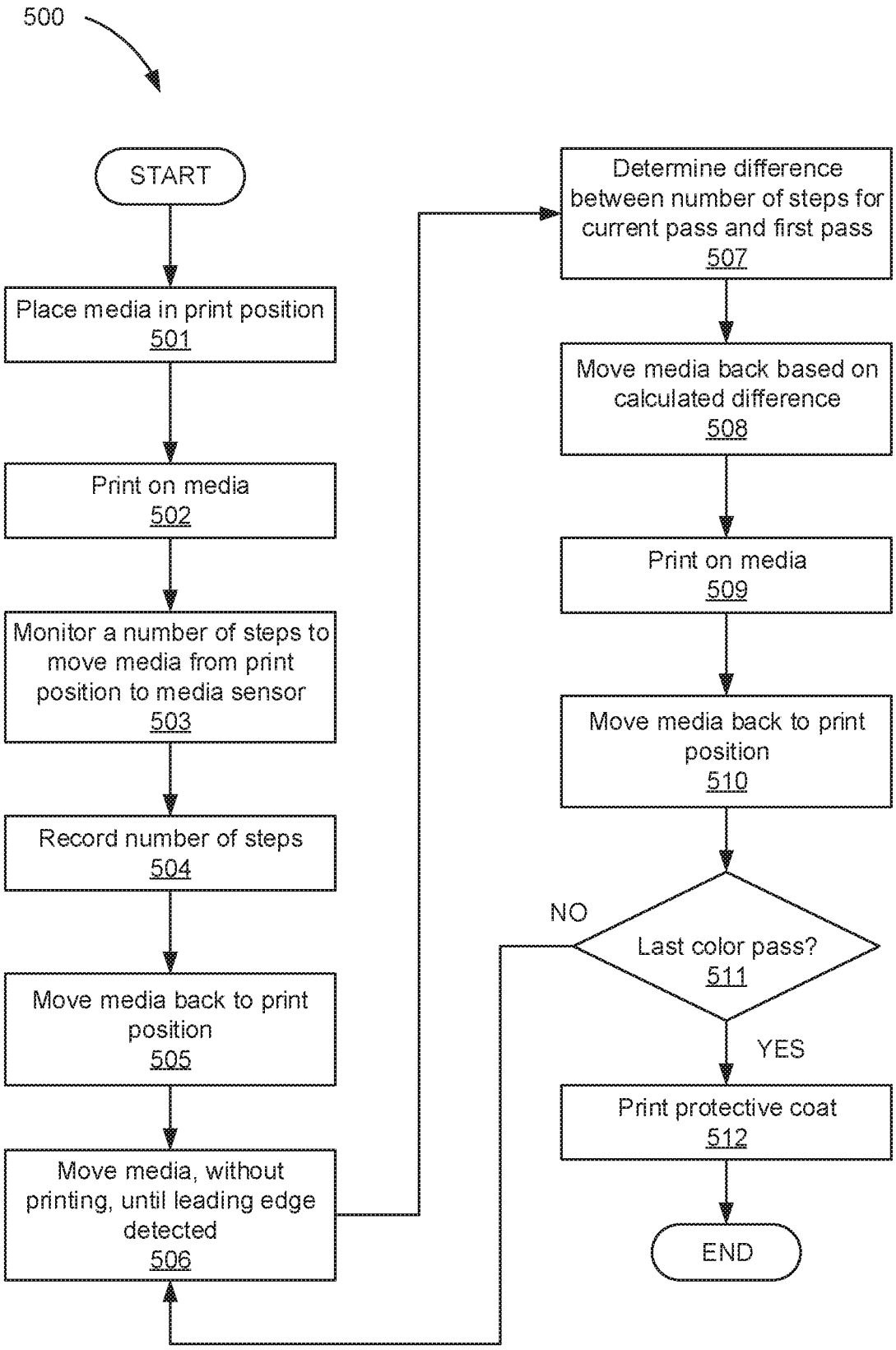
FIG. 5 is a flow chart of a method for stepper motor-based print adjustments, according to another example of the principles described herein.

In some examples, the controller (106) monitors and stores the number of steps in real-time during printing. That is, as a print job is processed, prior to each pass, a determination is made to the adjustments to be made during the pass to ensure proper registration during the different passes. FIG. 5 depicts a specific example of real-time printing adjustments.

The printing system (100) also includes a memory device (108) to store the number of steps of the stepper motor (104), for the at least one pass of the media. As with the memory of the controller (106), the memory device (108) may take many types of memory including volatile and non-volatile memory. For example, the memory may include Random Access Memory (RAM), Read Only Memory (ROM), optical memory disks, and magnetic disks, among others.

FIGS. 2A-2E are cross-sectional diagrams of a printing system (100) that makes stepper-based print adjustments at various stages of printing, according to an example of the principles described herein. FIGS. 2A-2E also depict other components of the printing system (100). That is, FIGS. 2A-2E depict the media sensor (102), which is downstream of a "print position" formed between two rollers (216-1, 216-2). FIGS. 2A-2E also depict the stepper motor (104), controller (106), and memory device (108) as described above in connection with FIG. 1.

FIGS. 2A-2E also depict the ribbon (210) that as described above, includes panels corresponding to the different compounds. Specifically, in one particular panel, the ribbon (210) may include panels of yellow, magenta, cyan, and a protective coating that are sequentially organized from end-to-end along the ribbon (210). While particular reference is made to particular panels on the ribbon (210), the ribbon (210) may be made up of panels of different and/or more compounds.

During printing, the ribbon (210) advances from a holding reel to a take-up reel as the media (214) is moved along the media path. FIGS. 2A-2E also depict the thermal printhead (212) that sublimates the compound from the ribbon (210) onto the media (214). That is, via a combination of pressure and temperature, the dye on the panels of the ribbon (210) are sublimated onto the media (214) such that the dye permanently affixes, at a molecular level, to the media (214), thus resulting in vibrant, high resolution print jobs.

As mentioned above, FIGS. 2A 2E depict different stages of a single pass of the media (214) through the printing region to receive a single compound from the ribbon (210). This process may be repeated multiple times, one for each compound to be deposited on the media (214). As is depicted in FIGS. 2A-2E, the media (214) path through the printing system (100) is along a single plane where media (214) is reversed along the media path in between passes. Throughout this specification, reference is made to FIGS. 2A 2E in visually indicating the state of the media (214) at different stages of the operation of the printing system (100) to adjust printing based on stepper motor (104) steps.

Figure 2A:
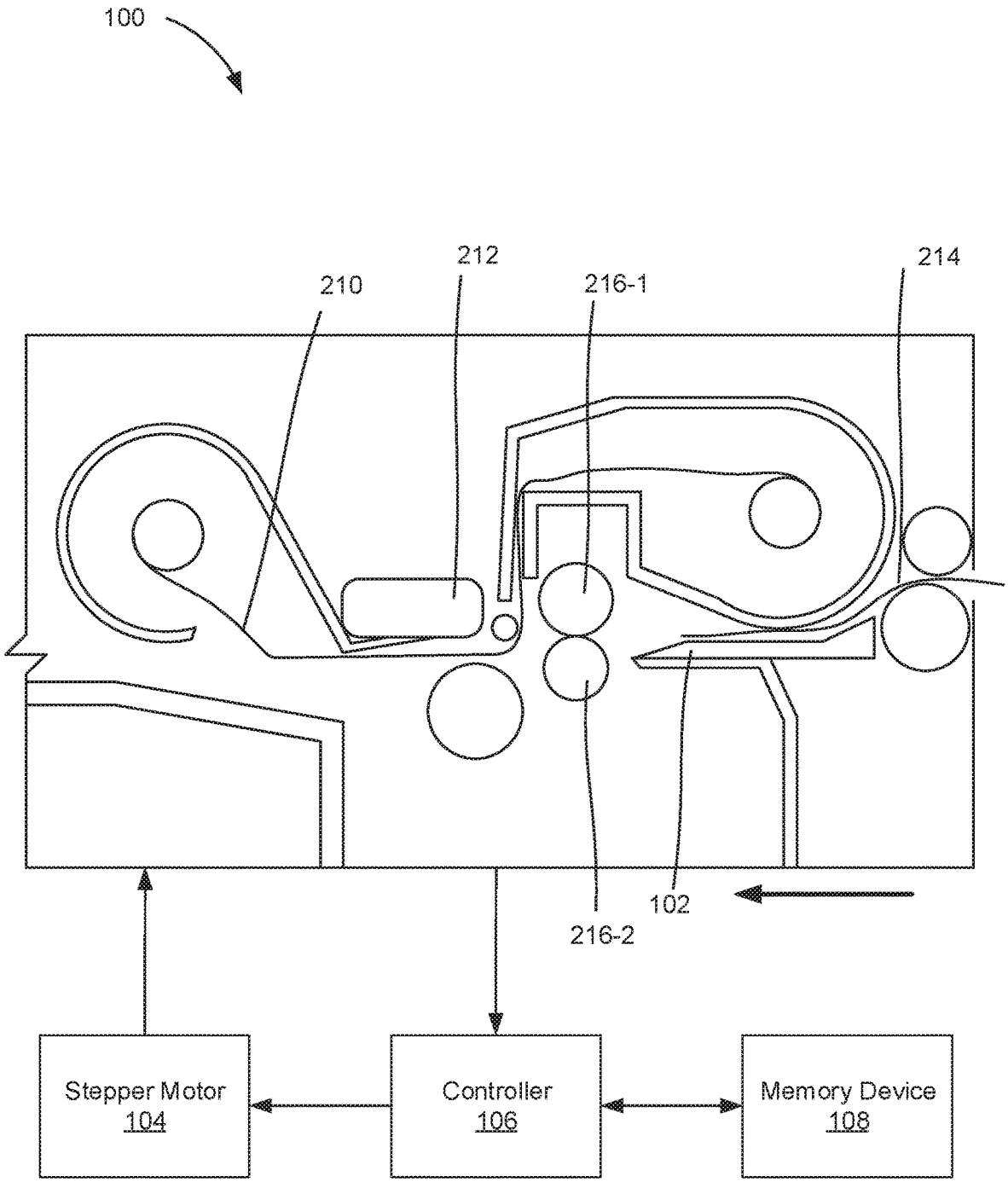
FIGS. 2A-2E are cross-sectional diagrams of a printing system that makes stepper-based print adjustments at various stages of printing, according to an example of the principles described herein.

First, FIG. 2A depicts a sheet of media (214) as it is introduced into the printing system (100). Note that in this example, the media (214) is introduced into the printing system (100) from the right side and travels towards the left. Note also that the trailing edge of the media (214) enters the printing system (100) before the leading edge of the media (214). As depicted in FIG. 2A, the media sensor (102) may be "ON" once the sheet of media (214) sits over the media sensor (102).

Figure 2B:
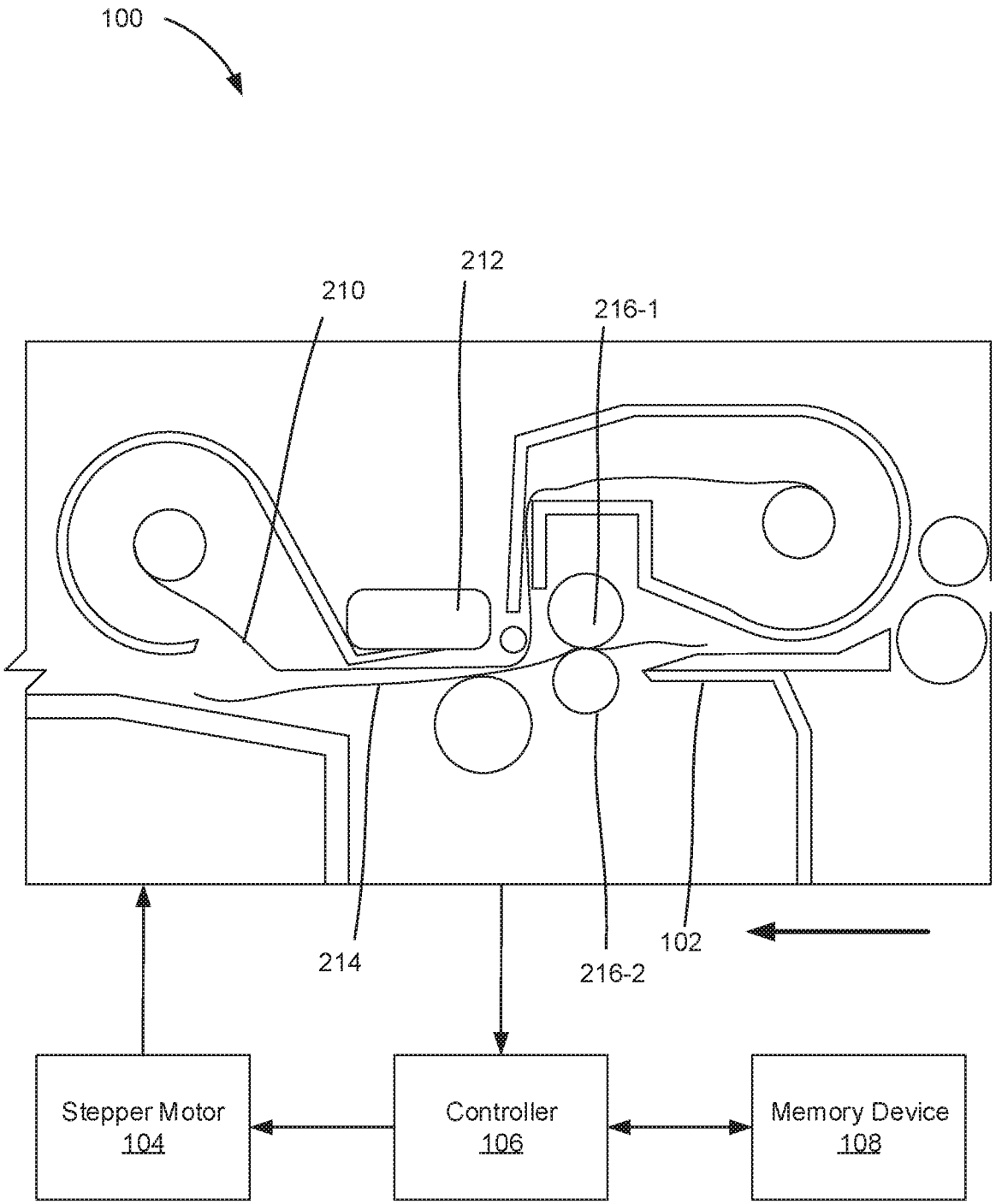

At a stage indicated in FIG. 2B, the media sensor (102) may be triggered to an "OFF" state once the sheet of media (214) is no longer over the media sensor (102). The stepper motor (104) continues to operate even after the media sensor (102) is in the "OFF" state to place the media in the print position indicated in FIG. 2C.

Figure 2C:
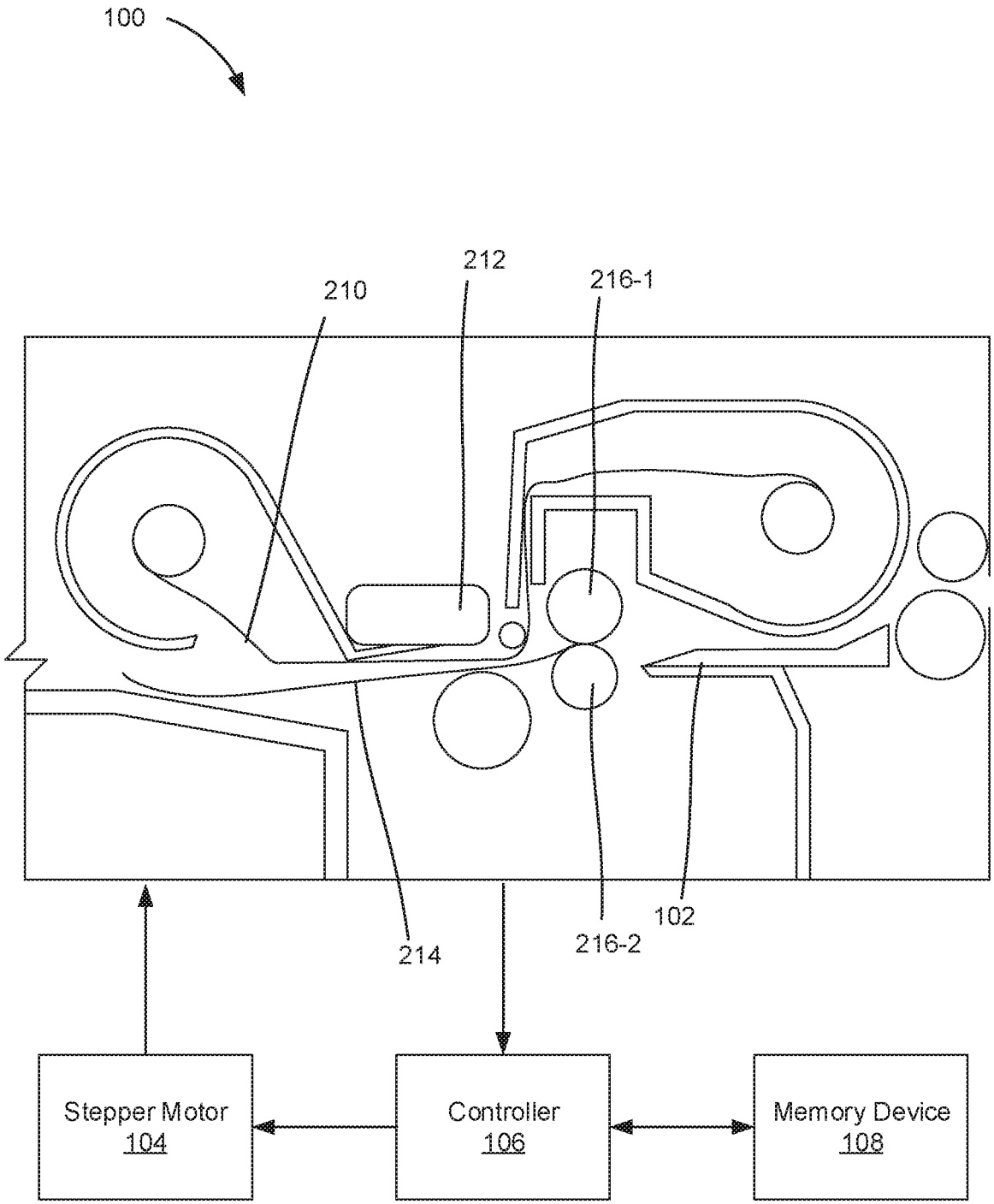

In FIG. 2C, the sheet of media (214) is in the print position between the rollers (216-1, 216-2). From this position, the media (214) may be advanced in a forward direction, i.e., towards the right.

Figure 2D:
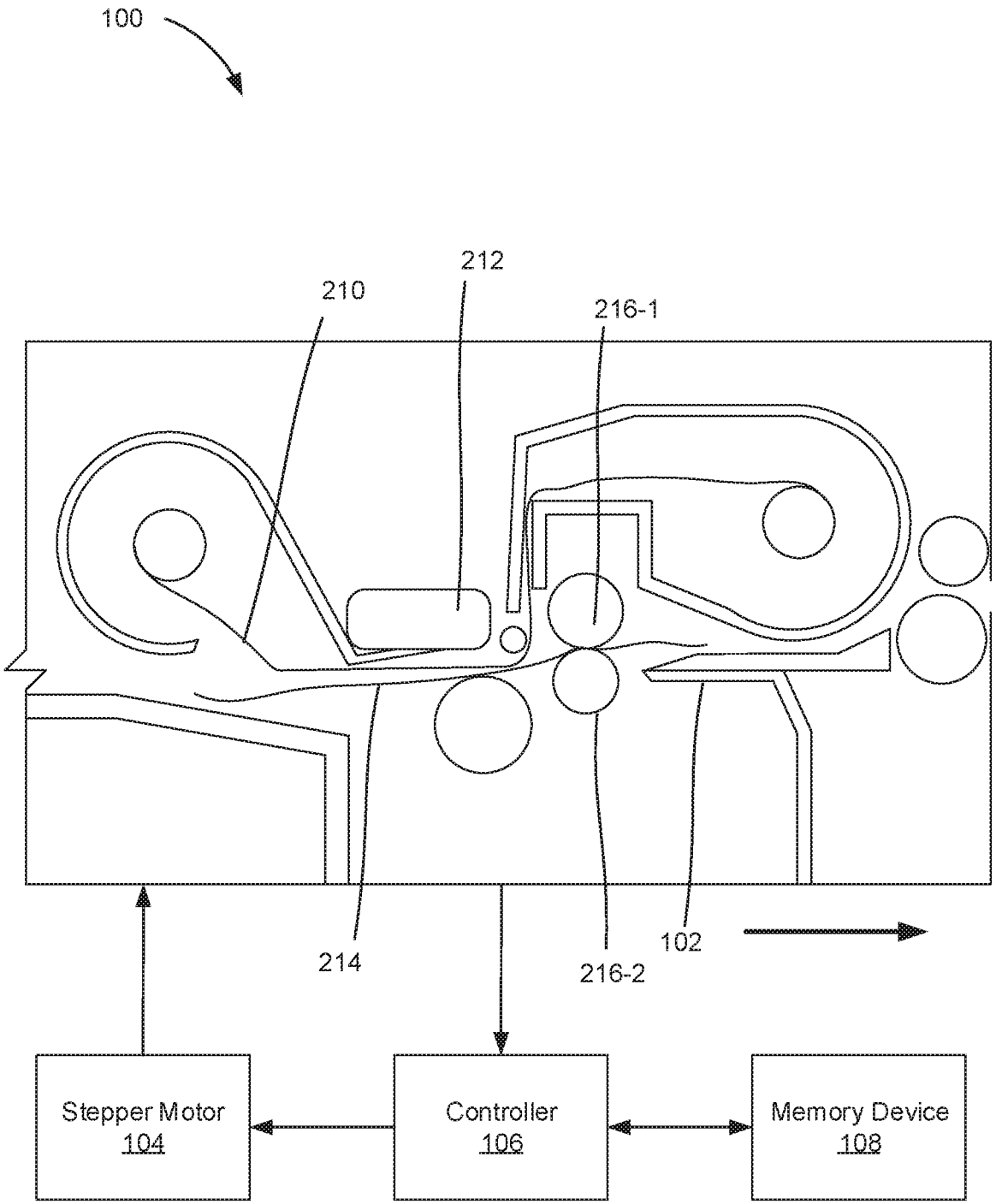

During printing, the sheet of media (214) passes over the media sensor (102) and triggers it to an "ON" state as depicted in FIG. 2D. The sheet of media (214) continues along this path until the entire media (214) is past the thermal printhead (212) as depicted in FIG. 2E.

Note that in this example, the sheet of media (214) does not pass out the exit of the printing system (100), but rather passes above certain rollers to be contained entirely within the printing system (100). The media (214) is then reversed back through the printing system (100) to the print position as depicted in FIGS. 2B and 2C such that additional passes of additional compounds may be made. When all passes have been made, the media is ejected out the exit onto a tray.

Figure 2E:
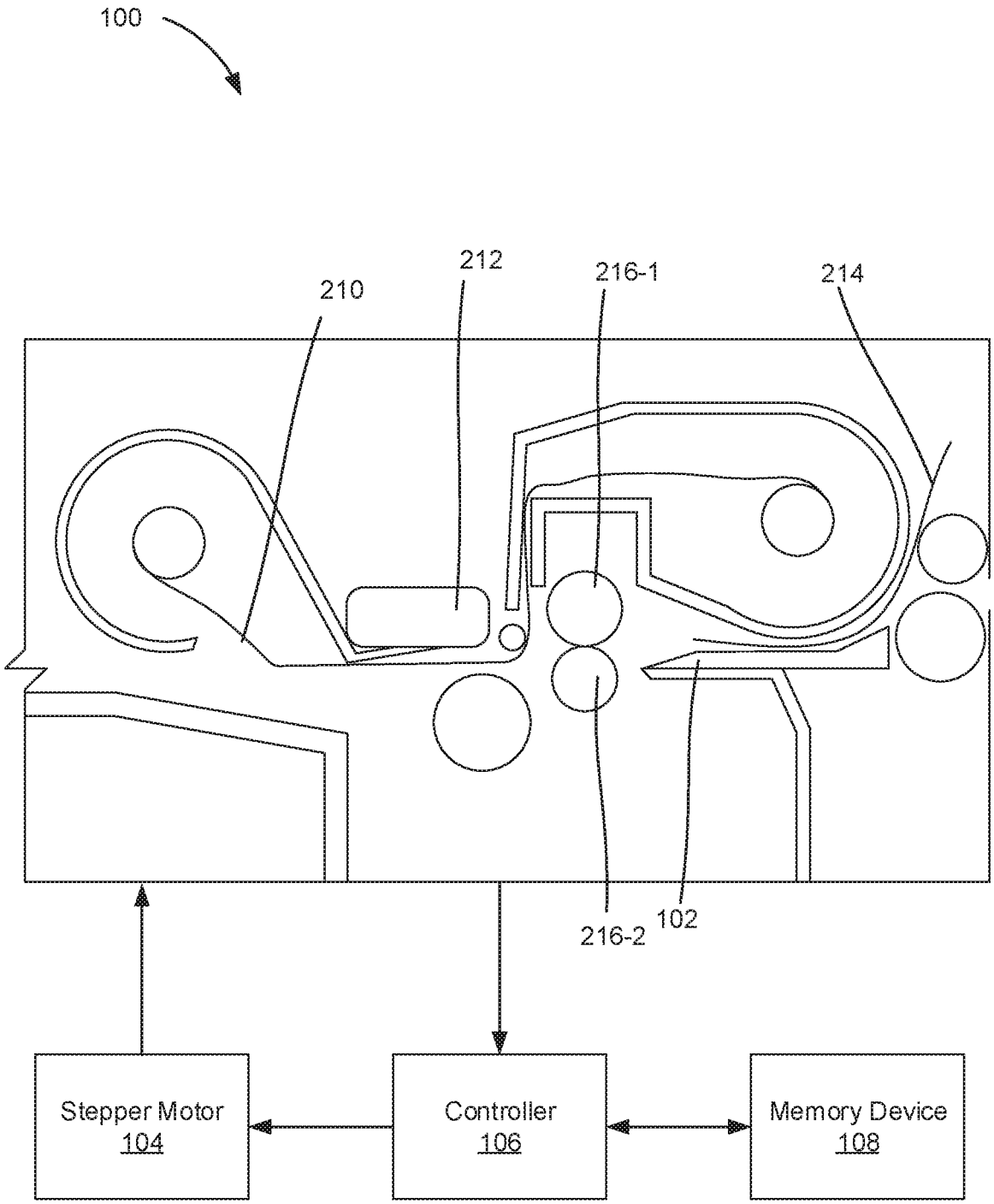

Note that the angle of the trailing edge of the sheet of media (214) relative to the media sensor (102) may be different between passes (as depicted in FIG. 2E), as compared to the angle when the sheet of media (214) enters the printing system (100) (as depicted in FIG. 2A).

Figure 3:
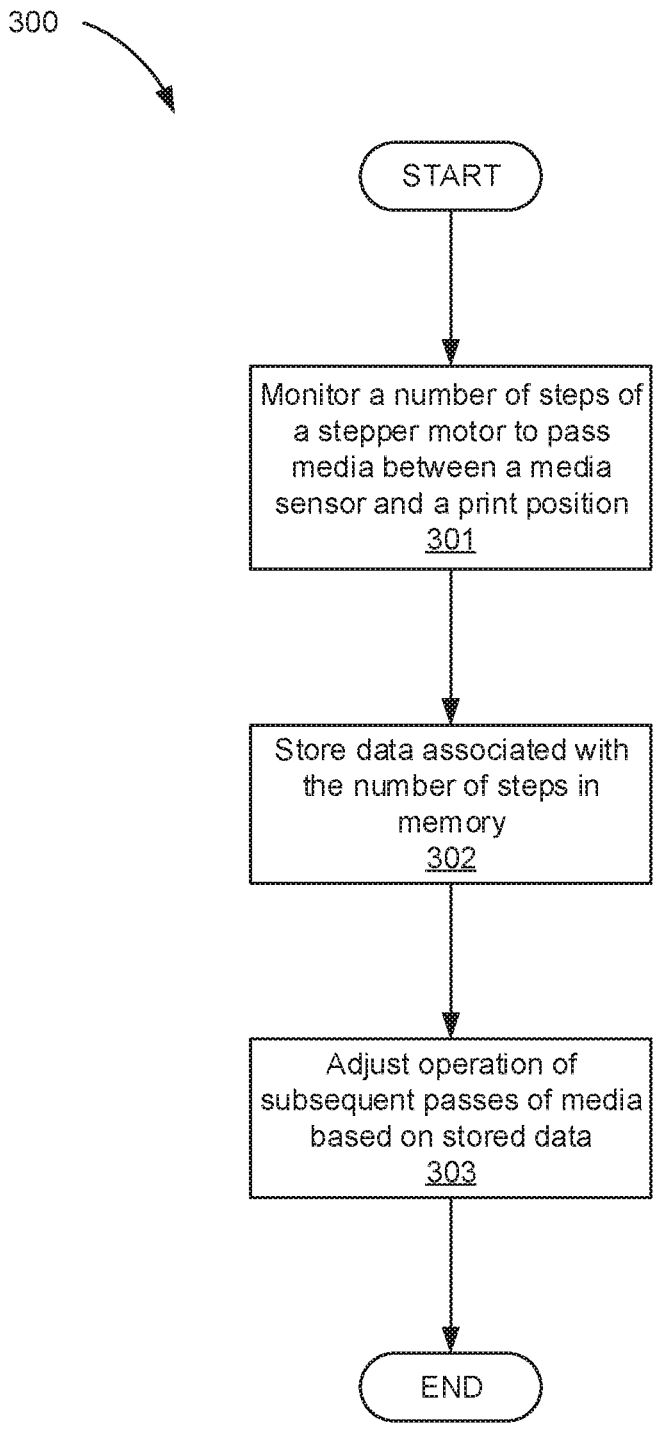
FIG. 3 is a flow chart of a method for stepper motor-based print adjustments, according to an example of the principles described herein.

FIG. 3 is a flow chart of a method (300) for stepper motor-based print adjustments, according to an example of the principles described herein. According to the method (300), a number of steps of a stepper motor (FIG. 1, 104) to pass media (FIG. 2, 214) between a media sensor (FIG. 1, 102) and a print position is monitored (block 301). As described above, the number of steps may be 1) from the media sensor (FIG. 1, 102) to the print position or 2) from the print position to the media sensor (FIG. 1, 102). Moreover, the monitoring (block 301) may be done for a single pass, which information is then used for each of the subsequent passes. In another example, the monitoring (block 301) is done for each pass. In this example differences are calculated between adjacent passes, and this difference value is used to adjust subsequent passes.

In either case, data associated with the number of steps is stored (block 302) in the memory device (FIG. 1, 108). In some examples, the data that is stored may be the number of steps of the stepper motor (FIG. 1, 104) during one pass or may be a difference in the number of steps of adjacent passes. Using whatever data is stored, the controller (FIG. 1, 106) adjusts (block 303) operation of subsequent passes of the media (FIG. 2, 214) through the printing region. As described above, what passes are monitored, what data is stored, and how that data is used to adjust printing operations within the printing system (FIG. 1, 100) may take a variety of forms. FIGS. 4A and 4B below describe an example where steps to move media (FIG. 2, 214) from a print position to the media sensor (FIG. 1, 102) are counted during a calibration period; FIG. 5 describes an example where steps to move media (FIG. 2, 214) from a print position to the media sensor (FIG. 1, 102) are counted in real time; and FIG. 6 describes an example where steps to move media (FIG. 2, 214) backwards along the media path from the media sensor (FIG. 1, 102) to the print position are counted.

FIGS. 4A and 4B are flow charts of a method (400) for stepper motor-based print adjustments; according to another example of the principles described herein. In general, according to the method (400) depicted in FIGS. 4A and 4B, during a calibration period an amount of steps taken by the stepper motor (FIG. 1, 104) to move the media (FIG. 2, 214) forward from a print position (as depicted in FIG. 2C) to triggering the media sensor (FIG. 1, 102) to "ON" (as depicted in FIG. 2D) is calculated and stored for multiple passes, i.e.; each of the color passes. The number of steps for adjacent passes is used to calculate the difference of steps between adjacent passes. For example, two difference offsets are calculated, one indicating difference of steps between yellow and magenta and the other indicating difference of steps between magenta and cyan. The stored differences are used as offset values, which are applied during a print job when media (FIG. 2, 214) goes through a magenta pass and a cyan pass.

In some examples, a second calibration event may be triggered as depicted in FIG. 4B where for a second image, an amount of steps taken by the stepper motor (FIG. 1, 104) to move the media (FIG. 2, 214) forward from a print position (as depicted in FIG. 2C) to triggering the media sensor (FIG. 1, 102) to "ON" (as depicted in FIG. 2D) is calculated and stored for each of the multiple passes and differences calculated between adjacent passes. If the differences calculated during the second calibration period are different from the recorded values (i.e., those calculated during the first calibration period) by less than a threshold amount, then the stored difference values from the first calibration period are retained. By comparison, if the differences calculated during the second calibration period are different from the recorded value in an amount larger than the threshold, then the new difference offsets are stored in memory.

According to the method (400), a first media (FIG. 2, 214) is placed (block 401) at the print position, as defined as the leading edge of the media (FIG. 2C, 214) being between the rollers (FIG. 2, 216) as indicated in FIG. 2C). In so doing, the printing system (FIG. 1, 100) may pick the sheet of media (FIG. 2, 214) from a tray as indicated in FIG. 2A. In transitioning to the print position, the media sensor (FIG. 1, 102) detects the trailing edge of the media (FIG. 2, 214) first as depicted in FIG. 2A, and then the leading edge of the media (FIG. 2, 214) second as depicted in FIG. 2B. In some examples, the movement of the media (FIG. 2, 214) between when the media sensor (FIG. 1, 102) is triggered "OFF" as depicted in FIG. 2B to being in the print position as depicted in FIG. 2C may be based on a predetermined number of stepper motor (FIG. 1, 104) steps.

The media (FIG. 2, 214) is then printed (block 402) on until it reaches a state indicated in FIG. 2E. That is, the thermal printhead (FIG. 2, 212) and the respective thermal elements are activated to sublimate a particular dye compound on to the media (FIG. 2, 214) in a particular pattern. During this time, the controller (FIG. 1, 106) monitors (block 403), the number of steps as described in connection in with FIG. 3. Specifically, in this example, monitoring the number of steps includes, during a first calibration period, monitoring (block 403) the number of steps to move media (FIG. 2, 214) from the print position to the media sensor (FIG. 1, 102). That is, from a position indicated in FIG. 2C to a position indicated in FIG. 2D and records (block 404) this number of steps to the memory device (FIG. 1, 108). This number of steps represents the relative distance in motor steps between the print position and the media sensor (FIG. 1, 102) as determined by the leading edge of the media (FIG. 2, 214). The media (FIG. 2, 214) is then moved (block 405) back to the start position as indicated in FIG. 2C.

During printing, when the media (FIG. 2, 214) is between the positions indicated in FIGS. 2D and 2E, the media sensor (FIG. 1, 102) is "ON" until the current pass is finished. While moving (block 405) back to the print position, the leading edge of the media (FIG. 2, 214) passes the media sensor (FIG. 1, 102) again and triggers the media sensor (FIG. 1, 102) to "OFF" as depicted in FIG. 2D.

In some examples, it is then determined (block 406) if the last pass was the last color pass. That is, as described above, after colored dye has been placed on the media (FIG. 2, 214), a protective coating may be formed.

If the last pass was not the last color pass (block 406, determination NO), the method (400) returns to printing (block 402) on the media (FIG. 2, 214), monitoring (block 403) a number of steps, recording (block 404) the number of steps, and moving (block 405) the media (FIG. 2, 214) back to the print position. In other words, in the example depicted in FIG. 4A, monitoring the number of steps 1) includes monitoring (block 403) the number of steps for each of multiple passes and 2) indicates the number of steps to pass media (FIG. 2, 214) from the print position to the media sensor (FIG. 1, 102). In a specific example where there are three color passes and a protective coat pass, the controller (FIG. 1, 106) monitors and stores the number of the stepper motor (FIG. 1, 104) steps taken from the time when the media (FIG. 2, 214) is located at the print position to when the media (FIG. 2, 214) first triggers the media sensor to "ON" for each of the three color passes.

If the last pass was the last color pass (block 406, determination YES), instead or printing on the media (FIG. 2, 214) and recording the number of steps, a protective coat is printed (block 407) on the media (FIG. 2, 214) and the media (FIG. 2, 214) is ejected from the printing system (FIG. 1, 100).

According to the method (400), a difference is determined (block 408) between the number of steps for two adjacent passes. For example, where color passes include a yellow pass, a magenta pass, and a cyan pass, differences may be calculated 1) between the number of steps for the yellow pass and the number of steps for the magenta pass and 2) between the number of steps for the magenta pass and the number of steps for the cyan pass. As described above in connection with FIG. 3, data associated with the number of steps monitored is stored. In this example, these difference values are the aforementioned data stored (block 409) in the memory device (FIG. 1, 108).

In some examples, the determined (block 408) difference values are divided by two, due to the stepper motor (FIG. 1, 104) half-steps, and then stored (block 409) in the memory device (FIG. 1, 108) for each of the color pairs. In other words, the difference values are divided by two because the stepper motor (FIG. 1, 104) is moving on half-steps, and the printing system (FIG. 1, 100) adjusts in full step increments. However, this is one specific example, and the number to divide by may be determined based on the stepper motor (FIG. 1, 104) steps ratio used.

In one example, a positive difference value would indicate that the media (FIG. 2, 214) on the current pass was short of the print position, i.e., that it did not fully reach the zero position, and a negative number of steps would mean that the media (FIG. 2, 214) on the current pass was greater than the print position, i.e., that the media (FIG. 2, 214) went farther back than the print position.

Note that the difference between the number of steps for the last color pass and any protective coat can be disregarded as the compound is clear and has no dye on it, and hence no contribution to the misregistration on a photo.

Note that in some examples, the method (400) may be performed during a first calibration period. That is, a calibration image may be printed such that stepper motor (FIG. 1, 104) steps could be calculated for each pass through the printing system (FIG. 1, 100) to print the calibration image. In some examples, the calibration image may be selected to easily detect registration differences. For example, the calibration image may include many dark regions as color misregistration is more easily detected in darkly printed content.

In some examples, no further calibration is performed before printing. However, in some examples, a secondary calibration period is executed as depicted in FIG. 4B.

As described above in regards to the first sheet of media (FIG. 2, 214), the second sheet of media (FIG. 2, 214) may similarly be placed (block 410) in the print position as depicted in FIG. 2C. The second sheet of media (FIG. 2, 214) is then printed (block 411) on through to a state depicted in FIG. 2E. During this time, the controller (FIG. 1, 106) monitors (block 412) the number of steps to pass the second sheet of media (FIG. 2, 214) from the print position to the media sensor (FIG. 1, 102), i.e., from a state depicted in FIG. 2C to a state depicted in FIG. 2D and records (block 413) this number of steps. The second sheet of media (FIG. 2, 214) is then moved (block 414) back to the print position as indicated in FIG. 2C.

In one particular example similar to the process in FIG. 4A, it is then determined (block 415) if the last pass was the last color pass. If not (block 415, determination NO), the method (400) returns to printing (block 411) on the media (FIG. 2, 214), monitoring (block 412) a number of steps, recording (block 413) the number of steps, and moving (block 414) the media (FIG. 2, 214) back to the print position.

In other words, in this second calibration period, the difference values determined (block 408) from FIG. 4A are verified by monitoring (block 412) again, for each of multiple passes a number of steps to move the second media from the print position to the media sensor (FIG. 1, 102).

If the last pass was the last color pass (block 415, determination YES), instead or printing on the media (FIG. 2, 214) and recording the number of steps, a protective coat is printed (block 416) on the media (FIG. 2, 214) and the media (FIG. 2, 214) is ejected from the printing system (FIG. 1, 100). Again, similar to the first calibration period, in this second calibration period, a difference is determined (block 417) between the number of steps for two adjacent passes.

When a second calibration period is used, the difference values measured during the first calibration period are compared (block 418) with respective difference values measured during the second calibration period. That is, in the specific example provided above, the yellow-magenta difference values determined in the first calibration period are compared (block 418) with the yellow-magenta difference values determined in the second calibration period and the magenta-cyan difference values determined during the first calibration period are compared (block 418) with the magenta-cyan difference values determined during the second calibration period. If the difference between either calculated difference is greater than a threshold (block 419, determination YES), the newly calculated difference value is stored (block 420) in the memory device (FIG. 1, 108), overwriting the difference value stored during the first calibration period. If the difference between respective calculated difference is within a threshold range (block 419, determination NO), the difference value stored during the first calibration period is retained.

In either case, operation of subsequent passes, i.e., processing a print job and not a calibration image, is adjusted (block 421) based on stored data. That is, during print jobs, when a magenta pass is processed, the action of the stepper motor (FIG. 1, 104) may be offset by the stored yellow-magenta difference value and when a cyan pass is processed, the action of the stepper motor (FIG. 1, 104) may be offset by the stored magenta-cyan difference value.

As a specific example, the yellow-magenta difference may be a +2, meaning that when in the print position to initiate a magenta pass, the media (FIG. 2, 214) is not as far back (i.e., not as far to the left in FIG. 2C) between the rollers (FIG. 2, 216) as compared to when in the print position to initiate a yellow pass. In this example, during the print job, after moving the media (FIG. 2, 214) back to the print position to start the magenta pass, the controller (FIG. 1, 106) may move the stepper motor (FIG. 1, 104) two more steps back to ensure it aligns with where the media (FIG. 2, 214) was when the yellow pass was initiated.

In some examples, the second calibration image includes each of the three colors printed in sequence per column and repeated in rows along the length of the media (FIG. 2, 214). This pattern verifies and validates the customized offset values on the photo by monitoring again the difference between each current pass and the previous pass and if it is less than the recorded value in half-steps then the offset value for each pass stays the same and is not changed. If it is bigger that the value stored previously, then a new offset is calculated and stored in memory.

FIG. 5 is a flow chart of a method (500) for stepper motor-based print adjustments, according to another example of the principles described herein. In general, according to the method (500) depicted in FIG. 5, the controller (FIG. 1, 106) monitors and stores the number of the stepper motor (FIG. 1, 104) steps taken from the time when the media (FIG. 2, 214) is located at the print position, as indicated in FIG. 2C, to when the media (FIG. 2, 214) first triggers the media sensor (FIG. 1, 102) to "ON" as depicted in FIG. 2D for a first pass. During this first pass, the media (FIG. 2, 214) may continue on until the media (FIG. 2, 214) has been fully printed on as depicted in FIG. 2E.

After the first pass is printed and the media (FIG. 2, 214) is at the print position for a second pass, the controller (FIG. 1, 106) instructs the stepper motor (FIG. 1, 104) to move the media (FIG. 2, 214) forward, but not the ribbon (FIG. 2, 210) such that the media (FIG. 2, 214) is not printed on. The media (FIG. 2, 214) is moved just until the leading edge of the media (FIG. 2, 214) triggers the media sensor (FIG. 1, 102) to "ON" as depicted in FIG. 2D. The difference between the number of steps of the first pass and the second pass is determined and the stepper motor (FIG. 1, 104) then reverses the media (FIG. 2, 214) to the print position as depicted in FIG. 2C based on the calculated difference. This is a short move between FIGS. 20 and 2D compared to the length of the media (FIG. 2, 214) and hence the error is negligible. This operation is repeated for each subsequent pass, i.e., after the first pass, where the media (FIG. 2, 214) is moved forward without printing just to the state indicated in FIG. 2D, number of steps counted and compared to a stored value, and the media (FIG. 2, 214) is returned based on the difference value. Using this method (500), the print position for each pass is the same as that of the first pass based on a series of short moves of the media (FIG. 2, 214) to the media sensor (FIG. 1, 102) so as to avoid misregistration on the printed output.

According to the method (500), media (FIG. 2, 214) is placed (block 401) at the print position, as defined as the leading edge of the media (FIG. 2, 214) being between the rollers (FIG. 2, 216) as indicated in FIG. 2C. This may be done as described above in connection with FIG. 4A.

The media (FIG. 2B, 214) is then printed (block 502) on until it reaches a state indicated in FIG. 2E. During this time, the controller (FIG. 1, 106) monitors (block 503), the number of steps to pass the media (FIG. 2, 214) from the print position to the media sensor (FIG. 1, 102), i.e., from a state depicted in FIG. 2C to a state depicted in FIG. 2D, and records (block 504) this number. The media (FIG. 2, 214) is then moved (block 505) back to the print position as indicated in FIG. 2C.

According to this method (500) for the second and subsequent passes, the media (FIG. 2, 214) is moved (block 506) along the media path, without printing, until the leading edge is detected at the media sensor (FIG. 1, 102). That is, the media (FIG. 2, 214) is moved (block 506) without printing from a state as indicated in FIG. 2C to a state as indicated in FIG. 2D, without continuing on to the state indicated in FIG. 2E. During this time, the controller (FIG. 1, 106) monitors the number of steps to pass the media (FIG. 2, 214) from the print position to the media sensor (FIG. 1, 102).

According to the method (500), the controller (FIG. 1, 106) then determines (block 507) a difference between the number of steps between this pass and the recorded (block 504) number of steps. For example, where the first pass was a yellow color pass and the current pass is a magenta color pass, a difference may be calculated between the number of steps for the yellow pass and the number of steps for the magenta pass. The media (FIG. 2, 214) is then moved (block 508) back based on the calculated difference. As a specific example, if the current pass is a magenta pass and if the yellow-magenta difference is a −2, the print media (FIG. 2, 214) is moved (block 508) back to the print position based on a default value, less two, to ensure it aligns with where the media (FIG. 2, 214) was when the yellow pass was initiated.

The printing system (FIG. 1, 100) then prints (block 509) on the media (FIG. 2, 214) through a position indicated in FIG. 2D and until the pass is completed and the media (FIG. 2, 214) is in a state indicated in FIG. 2E. The media (FIG. 2, 214) is then moved (block 510) back to the print position through the state indicted in FIG. 2D to the state indicated in FIG. 2C.

In some examples, it is then determined (block 511) if the last pass was the last color pass. If not (block 511, determination NO), the method (500) returns to moving (block 506) media without printing until the leading edge is detected, determining the number of steps for this movement and determining (block 507) a difference between this count and the count of steps for the first pass. The media is moved (block 508) back based on the difference, printed (block 509) on and after printing is complete moved (block 510) back to the print position.

In other words, in the example depicted in FIG. 5, a first pass is treated differently than subsequent passes. For example, the monitoring of the passes as described in FIG. 5 includes, for the first pass, monitoring (block 503) the number of steps of the stepper motor (FIG. 1, 104) to pass media from the print position to the media sensor (FIG. 1, 102). Then for each subsequent pass, prior to printing, the number of steps is monitored (block 506) to move the media (FIG. 2, 214) from the print position to the media sensor (FIG. 1, 102) without printing and a difference determined (block 507) between the number of steps for the current pass and the first pass. It is this difference that is stored in the memory device (FIG. 1, 108) and recalled for use in moving (block 508) the media (FIG. 2, 214) back to the print position after which the media (FIG. 2, 214) can be printed on (block 509) for the subsequent pass.

If the last pass was the last color pass (block 511, determination YES), instead or printing on the media (FIG. 2, 214) and recording the number of steps, a protective coat may be printed (block 512) on the media (FIG. 2, 214) and the media (FIG. 2, 214) is ejected from the printing system (FIG. 1, 100).

Figure 6:
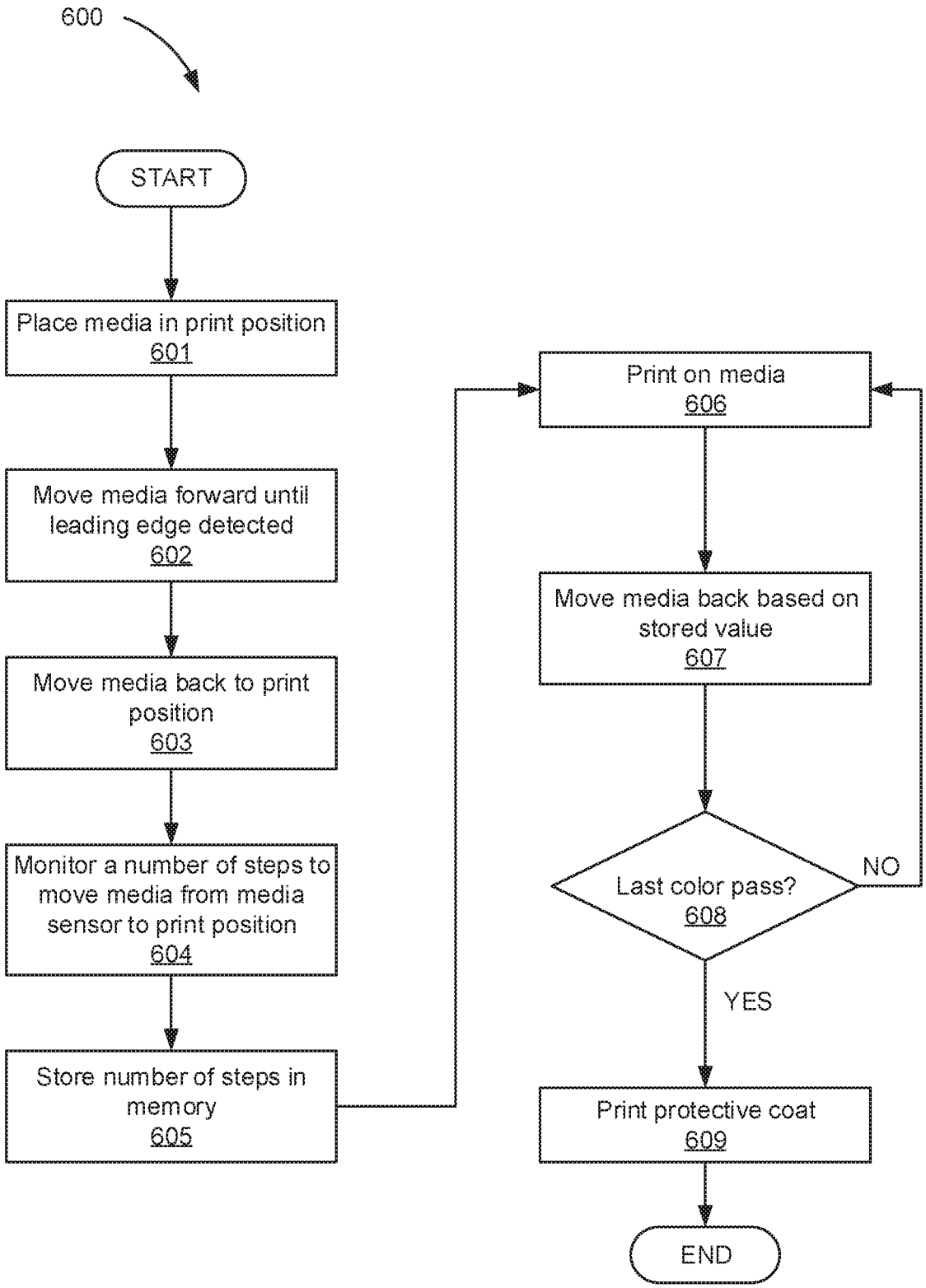
FIG. 6 is a flow chart of a method for stepper motor-based print adjustments, according to another example of the principles described herein.

FIG. 6 is a flow chart of a method (600) for stepper motor-based print adjustments, according to another example of the principles described herein. In general, according to the method (600) depicted in FIG. 6, rather than measuring a step count from print position to the media sensor (FIG. 1, 102), the controller (FIG. 1, 106) determines a step count backwards from the media sensor (FIG. 1, 102) to the print position. This step count is stored in the memory device (FIG. 1, 108). Then, during printing, at the end of each pass, the number of steps the controller (FIG. 1, 106) instructs the stepper motor (FIG. 1, 104) to take to return the page to the start print position for a subsequent pass, is called from the memory device (FIG. 1, 108).

According to the method (600), media (FIG. 2, 214) is placed (block 601) at the print position, as defined as the leading edge of the media (FIG. 2, 214) being between the rollers (FIG. 2, 216) as indicated in FIG. 2C. This may be done as described above in connection with FIG. 4A.

According to this method (600), the media (FIG. 2, 214) is moved (block 602), without printing until the leading edge is detected at the media sensor (FIG. 1, 102). That is, the media (FIG. 2, 214) is moved (block 602) without printing, from a state indicated in FIG. 2C to a state indicated in FIG. 2D, without continuing on to the state indicated in FIG. 2E.

The media (FIG. 2, 214) is then moved (block 603) back to the print position depicted in FIG. 2C. During this time, the controller (FIG. 1, 106) monitors (block 604), the number of steps to pass the media (FIG. 2, 214) from the media sensor (FIG. 1, 102) to the print position. That is, the controller (FIG. 1, 106) is monitoring (block 604) the number of steps from when the media (FIG. 2, 214) is moved in a reverse direction from a position indicated in FIG. 2D to when the media (FIG. 2, 214) is in a position indicated in FIG. 2C and then stores (block 605) the number of steps in the memory device (FIG. 1, 108).

The movement (block 602) forward prior to movement (block 603) backwards is to ensure accuracy in stepper motor (FIG. 1, 104) count. That is, when media (FIG. 2, 214) is first fed into the print position from the input tray, the trailing edge passes the media sensor (FIG. 1, 102) at a different angle as compared to when media (FIG. 2, 214) is fed into the print position in between passes. This is illustrated by comparing the different positions of the trailing edge of the media (FIG. 2, 214) between FIGS. 2A and 2E. As noted above, in the present specification, the trailing edge refers to the portion of the media (FIG. 2, 214) that receives the compound last, and therefore in the example of moving media between FIGS. 2D and 2C, passes by the media sensor (FIG. 1, 102) before the leading edge of the media (FIG. 2, 214).

This difference in angle may affect the step count. Accordingly, to ensure high accuracy color registration, the step count which is measured comes after the media (FIG. 2, 214) has initially been placed in the print position from its initial feed from the input tray, thus avoiding any step miscount that would result from counting steps as the media passes the media sensor (FIG. 1, 102) the first time directly from the input tray.

The media (FIG. 2, 214) is then printed (block 606) on until it reaches a state indicated in FIG. 2E. The sheet of media (FIG. 2, 214) is then moved (block 607) back based on the stored value to a position between the rollers (FIG. 2, 216) as indicated in FIG. 2C. For example, if the stored value is 25 steps, the stepper motor (FIG. 1, 104) is activated for 25 steps following the leading edge triggering the media sensor (FIG. 1, 102) to "OFF" as depicted in FIG. 2D, to place the media (FIG. 2, 2C) at a same position as for the first pass.

It is then determined (block 608) if the last pass was the last color pass. If not (block 608, determination NO), the method (600) returns to printing (block 608) on the media and moving the media (FIG. 2, 214) back based on the stored value for a subsequent pass.

In other words, for the second and subsequent color passes, the media (FIG. 2, 214) is reversed by the same amount as it was reversed following the first color pass to ensure proper media (FIG. 2, 214)/ribbon (FIG. 2, 210) alignment.

If the last pass was the last color pass (block 608, determination YES), instead of printing on the media (FIG. 2, 214) and recording the number of steps, a protective coat is printed (block 609) on the media (FIG. 2, 214) and the media (FIG. 2, 214) is ejected from the printing system (FIG. 1, 100).

In summary, according to the method (600) prior to printing, media (FIG. 2, 214) is advanced from the print position to the media sensor (FIG. 1, 102) and the number of steps are monitored, prior to printing, as the stepper motor (FIG. 1, 104) passes media (FIG. 2, 214) backwards from the media sensor (FIG. 1, 102) to the print position. In this example the data that is stored for subsequent adjustments is the number of steps.

Figure 7:
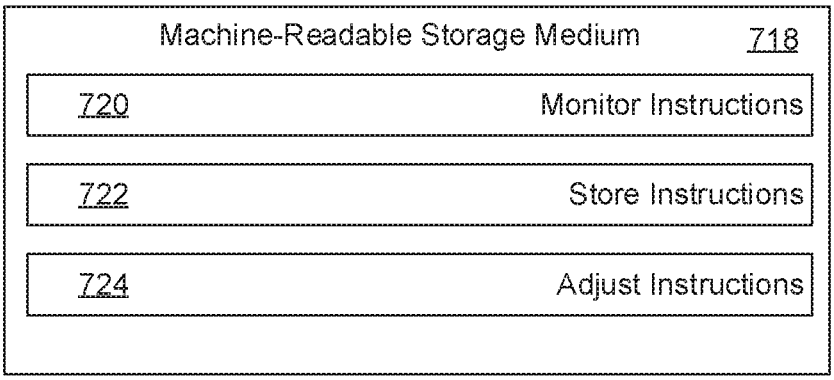
FIG. 7 depicts a non-transitory machine-readable storage medium for stepper motor-based print adjustments, according to an example of the principles described herein.

FIG. 7 depicts a non-transitory machine-readable storage medium (718) for stepper motor-based print adjustments, according to an example of the principles described herein. To achieve its desired functionality, a computing system includes various hardware components. Specifically, a computing system includes a processor and a machine-readable storage medium (718). The machine-readable storage medium (718) is communicatively coupled to the processor. The machine-readable storage medium (718) includes a number of instructions (720, 722, 724) for performing a designated function. The machine-readable storage medium (718) causes the processor to execute the designated function of the instructions (720, 722, 724).

Referring to FIG. 7, monitor instructions (720), when executed by the processor, cause the processor to monitor, for at least one pass media (FIG. 2, 214) through a printing region, a number of steps of a stepper motor (FIG. 1, 104) to pass media (FIG. 2, 214) between a media sensor (FIG. 1, 102) and a print position. Store instructions (722), when executed by the processor, may cause the processor to, store data associated with the number of steps of the stepper motor (FIG. 1, 104) into a memory device (FIG. 1, 108). Adjust instructions (724), when executed by the processor, may cause the processor to adjust operation of subsequent passes of the media (FIG. 2, 214) through the printing region based on stored data such that a start point of printing is the same for each pass.

Such systems and methods 1) reduce the cost associated with the use of an open-loop media drive; 2) prevent misalignment of color registration in a printed output; and 3) result in a higher quality printed output.

What is claimed is:

1. A printing system, comprising:

a media sensor to detect a presence of media at a particular point within the printing system;

a stepper motor to move the media through the printing system;

a controller to:

monitor, for at least one pass of the media, a number of steps of the stepper motor to pass the media between the media sensor and a print position;

store the number of steps of the stepper motor in a memory device; and adjust operation of subsequent passes of the media based on stored number of steps; and the memory device to store the number of steps of the stepper motor, for at least one pass of the media.

2. The printing system of claim 1, wherein the media passes through a printing region multiple times, each pass pertaining to deposition of a different compound.

3. The printing system of claim 2, further comprising:

a ribbon comprising panels corresponding to the different compounds; and a thermal printhead to sublimate the compound from the ribbon to the media.

4. The printing system of claim 1, wherein the controller:

monitors, for each of multiple passes, the number of steps to pass media from the print position to the media sensor; and stores, for each of multiple passes, the number of steps to pass media from the print position to the media sensor.

5. The printing system of claim 1, wherein the controller:

monitors, for a first pass, the number of steps of the stepper motor to pass media from the media sensor to the print position; and stores, for the first pass, the number of steps of the stepper motor to pass media from the media sensor to the print position.

6. The printing system of claim 1, wherein the media sensor is downstream of the print position.

7. The printing system of claim 1, wherein:

a media path through the printing system is along a single plane; and media is reversed along the media path in between passes.

8. The printing system of claim 1, wherein the controller is to:

monitor the number of steps for each of multiple passes; and determining a difference between the number of steps for two adjacent passes.

9. The printing system of claim 1, wherein the controller is to monitor the number of steps as the stepper motor passes the media from the media sensor to the print position against a media path.

10. The printing system of claim 9, wherein the controller is to adjust operation of a second pass of the media as the media moves along the media path based on the number of counts taken against the media path during a first pass.

11. A method, comprising:

monitoring, for at least one pass of media through a printing region, a number of steps of a stepper motor to pass media between a media sensor and a print position;

storing data associated with the number of steps of the stepper motor in a memory device; and adjusting operation of subsequent passes of the media through the printing region based on the stored data such that the subsequent passes align with the first pass.

12. The method of claim 11, wherein:

monitoring the number of steps:

comprises monitoring, during a first calibration period, the number of steps for each of multiple passes; and indicates indicating the number of steps to pass media from the print position to the media sensor;

the method further comprises determining a difference between the number of steps for two adjacent passes; and the stored data comprises the difference.

13. The method of claim 12, further comprising, during a second calibration period, verifying the offset by:

monitoring, for each of multiple passes, a number of steps to move second media from the print position to the media sensor;

determining a difference between the number of steps for at least two adjacent passes; and comparing the differences measured during the first calibration period with respective differences measured during the second calibration period.

14. The method of claim 11, wherein:

monitoring the number of steps comprises:

for a first pass, monitoring the number of steps of the stepper motor to pass media from the print position to the media sensor; and for each subsequent pass:

prior to printing:

monitoring the number of steps of the stepper motor to pass media from the print position to the media sensor; and determining a difference between the number of steps for a current pass and the number of steps for the first pass; and the data comprises the difference.

15. The method of claim 11, wherein:

the method further comprises, prior to printing, advancing media from the print position to the media sensor; and monitoring the number of steps comprises monitoring, prior to printing, the number of steps of the stepper motor to pass media from the media sensor to the print position;

wherein the data comprises the number of steps to pass media from the media sensor to the print position.

16. The method of claim 11, further comprising updating a stored number of steps responsive to a number of steps measured during a second calibration period being greater than a number of steps measured during a first calibration period.

17. The method of claim 11, further comprising preventing recordation of the number of steps for a protective coating pass.

18. A non-transitory machine-readable storage medium encoded with instructions executable by a processor, the machine-readable storage medium comprising instructions to:

monitor, for a first pass of media through a printing region and a second pass of media through the printing region, a number of steps of a stepper motor to pass media between a media sensor and a print position;

determine a difference between the number of steps for the first pass and the number of steps for the second pass;

store the determined difference in a memory device; and adjust operation of the second pass of the media through the printing region based on the determined difference such that a start point of printing is the same for each pass.

19. The non-transitory machine-readable storage medium of claim 18, wherein monitoring the number of steps and storing data are performed during a calibration period.

20. The non-transitory machine-readable storage medium of claim 18, wherein monitoring the number of steps and storing data are performed in real-time during printing.

* * * * *